United States Patent [19]

Arbuthnot et al.

[11] Patent Number: 4,692,240

[45] Date of Patent: Sep. 8, 1987

[54] APPARATUS AND A METHOD FOR SEPARATING ONE SOLID COMPONENT FROM ANOTHER SOLID COMPONENT IN SUSPENSION IN A LIQUID

[75] Inventors: Ian M. Arbuthnot, Northcliff; Errol T. Amm, Bryanston; Raymond J. Davidson, Victory Park, all of South Africa

[73] Assignee: Delkor Technik (Proprietory) Ltd. of Delkor House, Parktown, South Africa

[21] Appl. No.: 749,171

[22] Filed: Jun. 26, 1985

[30] Foreign Application Priority Data

Jun. 27, 1984 [ZA] South Africa ..... 84/4920
Feb. 28, 1985 [ZA] South Africa ..... 85/1540

[51] Int. Cl.[4] ..... B07B 1/10; B07B 1/50

[52] U.S. Cl. ..... 209/254; 209/272; 209/307; 209/380; 209/401; 210/160; 210/400

[58] Field of Search ..... 209/235, 254, 268, 272, 209/307, 308, 380, 401; 210/160, 400

[56] References Cited

U.S. PATENT DOCUMENTS 985,809 3/1911 Hoyt ..... 209/272
3,477,571 11/1969 Maag ..... 209/380 X
3,497,063 2/1970 Hirs ..... 210/400 X

FOREIGN PATENT DOCUMENTS 1045498 11/1953 France ..... 209/307
1336594 11/1973 United Kingdom ..... 209/401

*Primary Examiner*—Andres Kashnikow
*Attorney, Agent, or Firm*—Harness, Dickey & Pierce

[57] ABSTRACT

The separation of a first solid component from a mixture thereof with a liquid and a second solid component which is of smaller average particle size than the first solid component, the first and second solid components being in suspension in the liquid and with the percentage by mass of the second solid component being substantially greater than that of the first solid component, by means of a travelling endless cloth. The cloth passes through an operative separating region in a horizontal manner. The mixture is fed onto substantially the entire operative separating region from a feed box that has a floor with apertures therein; the floor being located above the cloth. The liquid and second solid component pass through the cloth, to be collected by a trough. The first solid component remains on the cloth and is subsequently removed and collected. Water is sprayed onto and through the cloth in the separating region, from below, to impede the formation of a cake or layer of the second solid component on the cloth.

13 Claims, 4 Drawing Figures

APPARATUS AND A METHOD FOR SEPARATING ONE SOLID COMPONENT FROM ANOTHER SOLID COMPONENT IN SUSPENSION IN A LIQUID

This invention relates to an apparatus for and to a method of separating a first solid component from a mixture thereof with a liquid and a second solid component, the first and second solid components being in suspension in the liquid.

The Applicant is aware of a large number of apparatus and methods for separating one solid component from another. Screens and cyclones are examples of such apparatus. It is proposed in this specification that an endless travelling cloth be used as the separating medium, and the Applicant is not aware of an endless cloth ever having been used for such a purpose.

The Applicant is nevertheless aware of a large number of filters that utilise an endless travelling cloth. These cloths are mostly supported by belts. However, the philosophy of a filter is totally different from that of the present invention. Thus, filters are intended to filter out solid particles that are in suspension in a liquid. With these prior filters the intention is to remove all the solid particles. With the present invention, the object is to separate the first solid component from the second solid component, with there being substantially more of the second solid component than there is of the first solid component, so that much more solid material passes through the apparatus than is removed by it.

According to the invention there is provided a separator for separating out a first solid component from a mixture thereof with a liquid and a second solid component which is of smaller average particle size than the first solid component, the first and second solid components being in suspension in the liquid and with the percentage by mass of the second solid component being substantially greater than that of the first solid component, which includes an endless cloth which is foraminous and has foramen which are of a suitable size to permit the second solid component to pass therethrough and to impede the passage therethrough of the first solid component;

a feed means for feeding the liquid and the solid components onto the cloth;

a liquid collecting means for collecting liquid and material that has passed through the cloth;

a first component removal and collecting means for removing material from the cloth and collecting it; and a drive means for displacing the cloth past the feed means, the liquid collecting means and the first component removal and collecting means.

Further according to the invention there is provided a method of separating a first solid component from a mixture thereof with a liquid and a second solid component which is of smaller average particle size than the first solid component, the first and second solid components being in suspension in the liquid and with the percentage by mass of the second component being substantially greater than that of the first component, which includes feeding the liquid and the solid components onto an endless cloth which has foramen of a suitable size to permit the passage therethrough of the second solid component and to impede the passage therethrough of the first solid component;

displacing the cloth;

collecting liquid and other material that has passed through the cloth; and removing from the cloth first component particles and collecting them.

The material may pass through the cloth under the action only of gravity without utilising an artificially created vacuum.

It will be appreciated that the first solid component and the second solid component may be particles of different size, shape or configuration although they are of the same material. Thus, coarse particles may be removed from a slurry after a milling operation. Instead, they may be different materials. In particular, the first solid component may be wood chips and the second solid component may be a gold-bearing chemical composition. Thus, the cloth may be such that particles having a size of less than 200 micron may pass through and particles of a greater size are retained thereon. Thus, for this application, the cloth may have foramen of about 250 microns. It will also be appreciated that the first solid component that is retained on the cloth is subsequently removed by any suitable process which may be a mechanical process.

Referring to the cloth, it may be of a synthetic monofilament fabric. It may also be woven and may be of polypropylene, polyester or a polyamide material. Further, it may be of a single, double or triple layer monofilament fabric.

The cloth preferably extends over a region in a substantially horizontal manner, this being the operative separating region of the cloth. The liquid collecting means, in the form of a trough, is then located below the cloth in this region. The mixture may then be fed onto the operative separating region by means of a feed box located above the said region. The feed box may have a floor that extends over substantially the entire separating region and is spaced from the cloth. The floor then has feed apertures which are distributed over substantially its entire area such that the liquid with the components in suspension therein is fed onto substantially the entire operative separating region.

Jets may be provided, below the cloth in the operative separating region, in order to spray water onto and through the cloth in an attempt to repulp the solids and prevent the formation of a layer of solid material on the cloth, which would stop the second solid component passing through the cloth, which is the stated objective.

The invention is now described, by way of an example, with reference to the accompanying drawings, in which.

Figure 1:
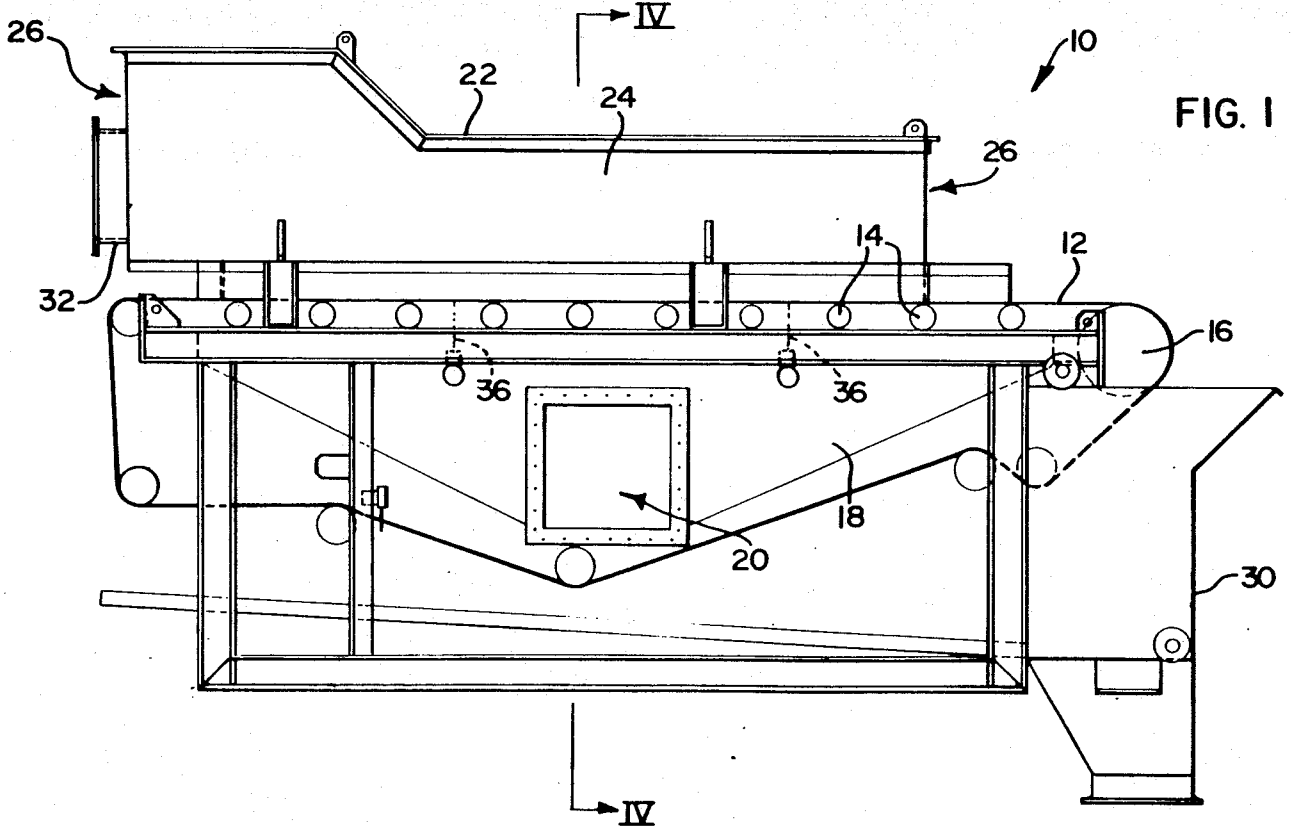
FIG. 1 shows a side view of a separator in accordance with the invention.
Figure 2:
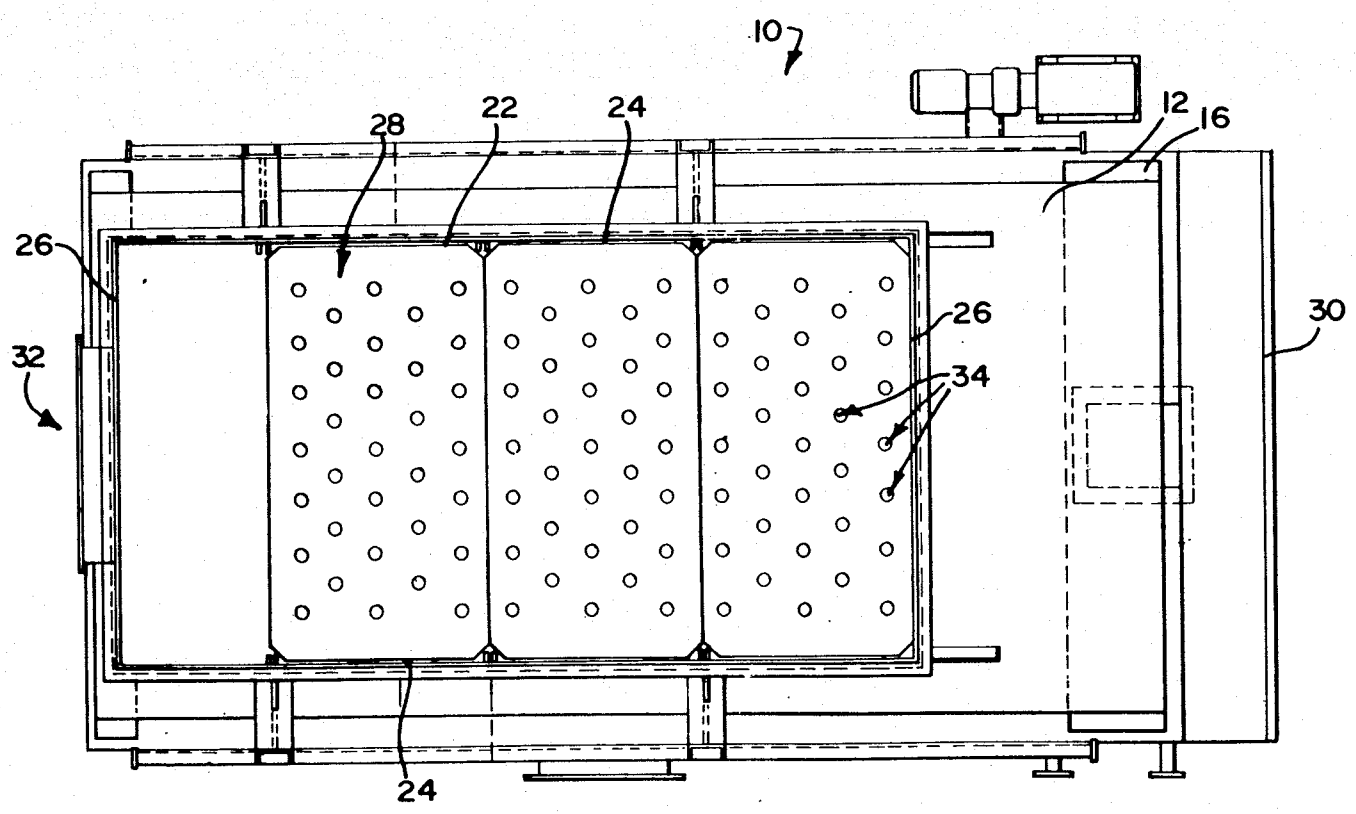
FIG. 2 shows a plan view of the separator.
Figure 3:
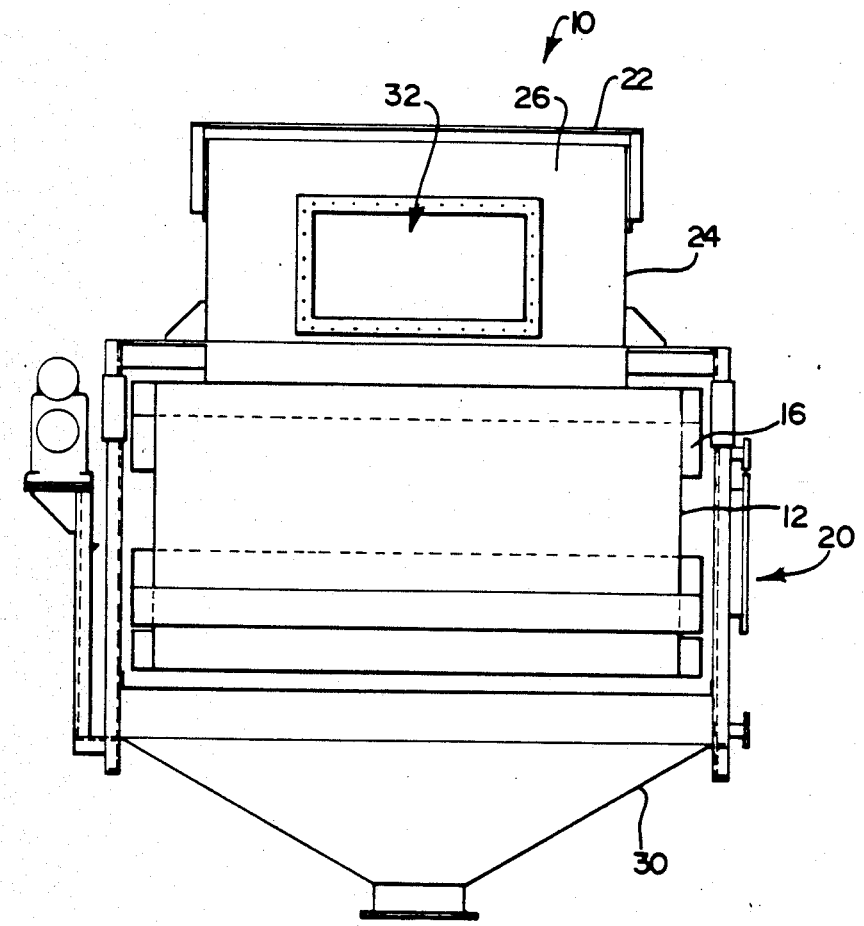
FIG. 3 shows an end view of the separator.
Figure 4:
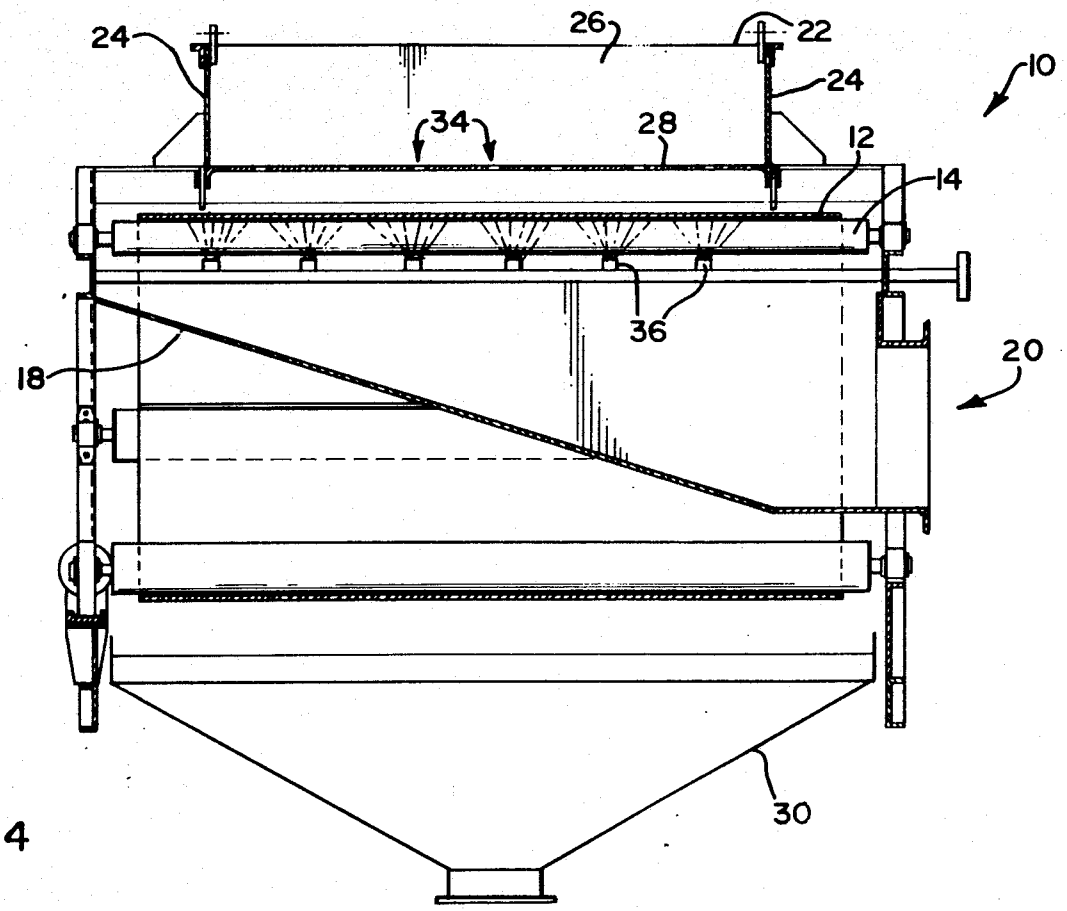
FIG. 4 shows a sectioned view of the separator along line IV—IV in FIG. 1.

Referring to the drawings, a separator is shown therein, designated generally by reference numeral 10. The separator 10 has an endless cloth 12 which is supported on a number of support rollers 14 to define a horizontal separating region and also passes over a number of other rollers, including a drive roller 16. Beneath the support rollers 14 there is a collecting trough 18 which has an outlet 20. Material that is to be separated is fed onto the cloth 12 by means of a feed box 22. The feed box 22 has side walls 24, end walls 26 and a floor 28. An inlet 32 is provided in the rear end wall 26. The floor 28 has a number of circular apertures 34 that have a diameter of 1 to 2 cms and which are distributed over substantially the entire floor 28. The floor 28 is spaced a few centimeters from the cloth 12, and extends over a substantial part of the operative separating region. Thus, the feed box 22 feeds material to be separated, in a distributed manner, onto substantially all of the operative separating region.

The cloth 12 is a fabric that is woven from a suitable synthetic mono-filament material. The material may be polypropylene, polyester or polyamide. The cloth is woven to have apertures of a suitable size depending on the application for which it is intended. Thus, in one application where it is desired to separate wood particles which are carried in a slurry of gold-bearing particles in suspension in water, in which the gold-bearing particles have a maximum particle size of about 200 microns, the cloth is provided with apertures of about 250 microns in size. Thus, when the material to be separated is fed onto the cloth 12 by means of the feed box 22 the slurry passes through the cloth 12 under the action of gravity to be collected in the trough 18 whereas the wood particles remain behind on the cloth 12. These are then washed off the cloth 12 to be collected in a trough 30.

Sprays 36 are located below the cloth 12 in the operative region, ie between support rollers 14, to spray water onto and through the cloth 12, to repulp any solid material tending to form a layer on the cloth 12.

The cloth 12 is driven at a speed of between 2 and 9 meters/minute if wood particles are to be removed from gold bearing slurry and between 5 and 30 meters/minute when particles that are to large are to be removed from a slurry after a milling operation.

By means of the invention, an apparatus and method are provided whereby, in general, larger particles that form a small part of the solid material in suspension in a liquid may be removed therefrom in a continuous manner, and in particular, wood particles may be easily removed from a gold bearing slurry.

We claim:

1. A gravity operable separator for separating out a first solid component from a mixture thereof with a liquid and a second solid component which is of smaller average particle size than the first solid component, the first and second solid components being in suspension in the liquid and with the percentage by mass of the second solid component being substantially greater than that of the first solid component, which includes an endless cloth which is foraminous and has foramen which are of a suitable size to permit the second solid component to pass therethrough and to impede the passage therethrough of the first solid component, a part of the cloth being substantially horizontal and defining an extended operative separating region;

a feed means for feeding the liquid and the solid components onto the cloth in a distributed and continuous manner directly onto a substantial portion of that part of the cloth that defines the operative separating region, the feed means including a feed box that has a floor plate with a number of distributed feed openings and which is spaced from the cloth;

a liquid collecting means for collecting liquid and material that has passed through the cloth, the liquid collecting means being located beneath that part of the cloth defining the operative separating region;

a first component removal and collecting means for removing material from the cloth and collecting it; and a drive means for continuously displacing the cloth past the feed means, the liquid collecting means and the first component removal and collecting means whilst liquid and the solid components are being fed onto the cloth.

2. The separator as claimed in claim 1, in which the cloth is of a synthetic monofilament fabric.

3. The separator as claimed in claim 2, in which the cloth is of a woven fabric.

4. The separator as claimed in claim 2, in which the cloth is of a single, double or triple layer monofilament fabric.

5. The separator as claimed in claim 1, which includes a spray means for spraying liquid onto the underneath surface of th cloth that is located immediately beneath the feed means.

6. A separator as claimed in claim 1 for removing wood chips from a mixture thereof with gold bearing particles, in which the cloth has foramen of about 250 microns.

7. A separator as claimed in claim 1, for removing coarse particles from a slurry after a milling operation.

8. A method of separating out a first solid component from a mixture thereof with a liquid and a second solid component which is of smaller average particle size than the first solid component, the first and second solid components being in suspension in the liquid and with the percentage by mass of the second component being substantially greater than that of the first component, which includes feeding the liquid and the solid components onto an endless cloth which has foramen of a suitable size to permit the passage therethrough of the second solid component and to impede the passage therethrough of the first solid component, by charging the liquid and solid components into a feed box that has a floor plate which is spaced from and extends over a substantial portion of a part of the cloth that is substantially horizontal and which defines an operative separating region, the floor plate having a number of distributed feed openings, and passing the liquid and solid components through the openings in the floor plate directly onto a substantial portion of that part of the cloth defining the operative separating region to allow the liquid and second component particles to pass through the cloth under the action of gravity only;

displacing the cloth whilst liquid and solid components are being fed thereon;

collecting liquid and other material that has passed through the cloth; and removing from the cloth first component particles and collecting them.

9. The method claimed in claim 8, in which the cloth is displaced at a speed of between 2 and 30 meters/minute.

10. The method claimed in claim 8, which includes spraying liquid onto the underneath surface of that part of the cloth onto which material is being fed.

11. The method claimed in claim 8, in which wood chips are removed from a gold bearing slurry.

12. The method claimed in claim 8, in which fine carbon particles are removed from a slurry.

13. The method claimed in claim 8, in which coarse particles are removed from a slurry after a milling operation.

* * * * *